US008480813B2

(12) United States Patent
Molitor et al.

(10) Patent No.: US 8,480,813 B2
(45) Date of Patent: Jul. 9, 2013

(54) METHOD OF CLEANING RETURNED BEVERAGE BOTTLES IN A BOTTLE FILLING PLANT, A METHOD OF INTRODUCING TREATMENT FLUID INTO CONTAINERS TO REMOVE CONTAMINANTS THEREFROM IN A CONTAINER FILLING PLANT, AND AN ARRANGEMENT THEREFOR

(75) Inventors: Bernd Molitor, Fröndenberg (DE); Ulrich Wiedemann, Dortmund (DE); Falk Dittrich, Castrop-Rauxel (DE)

(73) Assignee: KHS GmbH, Dortmund (DE)

( * ) Notice: Subject to any disclaimer, the term of this patent is extended or adjusted under 35 U.S.C. 154(b) by 765 days.

(21) Appl. No.: 12/437,956

(22) Filed: May 8, 2009

(65) Prior Publication Data

US 2010/0116295 A1 May 13, 2010

Related U.S. Application Data

(63) Continuation-in-part of application No. PCT/EP2007/009630, filed on Nov. 7, 2007.

(30) Foreign Application Priority Data

Nov. 10, 2006 (DE) ..... 10 2006 053 370

(51) Int. Cl.
*B08B 9/28* (2006.01)

(52) U.S. Cl.
USPC ..... 134/22.18; 134/23; 134/24; 134/25.4; 134/62; 134/166 R

(58) Field of Classification Search
None
See application file for complete search history.

(56) References Cited

U.S. PATENT DOCUMENTS 3,952,925 A 4/1976 Babunovic et al.
3,955,588 A * 5/1976 Born ..... 134/129

(Continued)

FOREIGN PATENT DOCUMENTS

DE 7 102 512 4/1971
DE 43 30 335 3/1995

(Continued)

OTHER PUBLICATIONS

International Search Report PCT/EP2007/009630 and English translation thereof.

(Continued)

*Primary Examiner* — Michael Kornakov
*Assistant Examiner* — Ryan Coleman
(74) *Attorney, Agent, or Firm* — Nils H. Ljungman & Associates

(57) ABSTRACT

A method of introducing treatment fluid into containers to remove contaminants therefrom in a container filling plant, and an arrangement therefor. The abstract of the disclosure is submitted herewith as required by 37 C.F.R. §1.72(b). As stated in 37 C.F.R. §1.72(b): A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims. Therefore, any statements made relating to the abstract are not intended to limit the claims in any manner and should not be interpreted as limiting the claims in any manner.

20 Claims, 5 Drawing Sheets

U.S. PATENT DOCUMENTS

| | | | | |
|---|---|---|---|---|
| 2002/0162583 | A1* | 11/2002 | Abe | 134/166 R |
| 2006/0213541 | A1 | 9/2006 | Burgess | |

FOREIGN PATENT DOCUMENTS

| | | |
|---|---|---|
| DE | 43 35 368 | 4/1995 |
| DE | 44 12 441 | 11/1995 |
| DE | 196 37 860 | 3/1998 |
| EP | 0 134 830 | 3/1985 |
| JP | 8033879 A | 2/1996 |

OTHER PUBLICATIONS

International Preliminary Report on Patentability PCT/EP2007/009630 and English translation thereof.

* cited by examiner

METHOD OF CLEANING RETURNED BEVERAGE BOTTLES IN A BOTTLE FILLING PLANT, A METHOD OF INTRODUCING TREATMENT FLUID INTO CONTAINERS TO REMOVE CONTAMINANTS THEREFROM IN A CONTAINER FILLING PLANT, AND AN ARRANGEMENT THEREFOR

CONTINUING APPLICATION DATA

This application is a Continuation-In-Part application of International Patent Application No. PCT/EP2007/009630, filed on Nov. 7, 2007, which claims priority from Federal Republic of Germany Patent Application No. 10 2006 053 370.4, filed on Nov. 10, 2006. International Patent Application No. PCT/EP2007/009630 was pending as of the filing date of this application. The United States was an elected state in International Patent Application No. PCT/EP2007/009630.

BACKGROUND

1. Technical Field

The present application relates to a method of cleaning returned beverage bottles in a bottle filling plant, a method of introducing treatment fluid into containers to remove contaminants therefrom in a container filling plant, and an arrangement therefor.

2. Background Information

Background information is for informational purposes only and does not necessarily admit that subsequently mentioned information and publications are prior art.

The present application relates to a sprayer station of a cleaning machine for the cleaning of bottles or similar containers with at least one spray nozzle for the introduction of at least one spray jet of a spray or treatment fluid into the containers with a container mouth that are being moved past the spray nozzle by means of a transport system during a spraying phase, in which the individual containers are located in the area of coverage of the at least one spray nozzle, and with means to vary the at least one spray jet. The present application also relates to a container cleaning machine for the cleaning of bottles or similar containers, with at least one sprayer station past which the containers are moved in container receptacles, as well as to a method for the operation of a container cleaning machine for the cleaning of bottles or similar containers with at least one sprayer station past which the containers are moved in container receptacles.

In some container cleaning machines, for example including bottle cleaning machines, for the cleaning process, the containers are moved in container receptacles or cells which are formed on container carriers or container baskets of a transport system by means of this transport system through treatment zones, and for example, among other things, through treatment zones which are formed by at least one sprayer station and in which an interior spraying of the containers takes place. In this case, some container cleaning machines disclose for example that the spray nozzles or nozzle openings of such a sprayer station are provided on nozzle shafts which are rotated in synchronization with the transport movement of the transport system, and for example to pivot the spray jets that exit the nozzle openings and to completely interrupt the spray jets when no containers are in the area of coverage of the spray nozzles.

Some container cleaning machines also describe the realization of pulsed spray jets, and for example first so that the influx of the spray medium to the spray nozzles of a sprayer station is completely interrupted when there is no container or container carrier in the area of coverage of the nozzles of this sprayer station.

In an additional form of the present application the spray jet is interrupted multiple times when there are containers in the area of coverage of the nozzles.

One disadvantage of these known methods is that a high frequency of the complete interruption of the spray leads to undesirable pressure pulses.

Some cleaning machines describe an apparatus in which the spray jets that get into the bottle are varied by varying their orientation or direction during the spraying process. For this purpose, this publication teaches a spray carriage that moves along with the bottles which can be pivoted around its longitudinal and transverse axis. The actual pivoting movement is produced because of undulations in the guide track of the spray carriage, or because the wheels of the spray carriage are oval. The direction of the spray jet is varied by these pivoting movements. There is no variation in the volume of the spray jet.

OBJECT OR OBJECTS

An object of the present application is to create a sprayer station with which an improved action of the treatment fluid on the containers is achieved. An additional object of the present application is the conservation of fresh water.

SUMMARY

These objects are accomplished by a sprayer station of a cleaning machine for the cleaning of bottles or similar containers with at least one spray nozzle for the introduction of at least one spray jet of a spray or treatment fluid into the containers with a container mouth. The containers are being moved past the spray nozzle by means of a transport system during a spraying phase, in which the individual containers are located in the area of coverage of the at least one spray nozzle. The sprayer station comprises means to vary the at least one spray jet. The means for the variation of the spray jet are realized so that the at least one spray jet is varied at least once during each work cycle or during each spraying phase. A container cleaning machine is the object of a container cleaning machine for the cleaning of bottles or similar containers, with at least one sprayer station past which the containers are moved in container receptacles. The sprayer station is realized as the sprayer station according to the present application. A method is the object of a method for the operation of a container cleaning machine for the cleaning of bottles or similar containers with at least one sprayer station past which the containers are moved in container receptacles. The at least one spray jet is varied at least once during a work cycle or during a spraying phase.

Known cleaning machines for the cleaning of bottles or similar containers generally work in cycles, whereby the containers held in the container carriers are moved past all or substantially all or most of the treatment stations necessary and/or desired for the complete or substantially complete treatment of the containers in the course of a plurality of operating cycles. At least one of these treatment stations is a spraying station. The function of these spraying stations is to spray fluid in a suitable manner into the interior and/or on the outside walls of the containers and/or of other such objects. The interval of time during which the fluid is discharged, which is also called the spraying phase, can begin at the same time or end at the same time as the work cycle, although it can also be chronologically offset from the work cycle. The spraying phase can equal the length of a work cycle, or it can also be shorter than the work cycle.

In the spraying station according to the present application, during a work cycle or during a spraying phase, i.e. during the period in which a container is within the range of coverage of the at least one spray nozzle, the spray jet that exits this nozzle is varied in a controlled manner at least once so that this spray jet is interrupted or reduced at least during a portion of the spraying phase or in an interim phase between spraying phases. In at least one possible embodiment of the present application, for example, the spray jet is reduced so that in vertical terms, it ends outside the container before it reaches the mouth of the container. In this partial or interim phase of the spraying process, any contaminated spraying or treatment fluid can drain completely or substantially completely or drain partially out of the container into which it was previously introduced by means of the one spray nozzle, whereupon, among other things, the treatment with the treatment fluid introduced in an additional partial phase into the containers via the spray nozzle is further intensified.

The present application may be used for the spraying of water, treatment fluid, cleaning fluid, disinfectant, spraying fluid, and/or other types of media for the cleaning and/or treating of bottles prior to filling. Additionally, the present application may be used for the cleaning of returned bottles or containers or also for new bottles or containers.

Additionally, in at least one possible embodiment of the present application, the nozzles may be configured to eject a treatment or cleaning fluid. This ejection of fluid may be a spray or a stream, such as an uninterrupted stream of fluid or a plurality of uninterrupted streams of fluid. Likewise, each nozzle may comprise a supply orifice for an uninterrupted stream of fluid or a plurality of supply orifices for a plurality of uninterrupted streams of fluid. For example, each spray nozzle or nozzle or nozzle arrangement may comprise multiple openings, so each nozzle ejects a plurality of uninterrupted streams of fluid into each bottle during the spraying phase.

The spray jet can be controlled, for example, by control means that are located in a supply line of the spray nozzle, and in one possible embodiment so that the quantity of treatment fluid fed to the spray nozzle and/or the pressure of the treatment fluid at the spray nozzle can be varied at least once during the spraying phase. The control means can thereby be formed, for example, by a flow control valve and/or a pump with a regulated, in one possible embodiment frequency-regulated drive.

In one possible embodiment of the present application, the spray jet can also or may also be reduced even if there is no container in the area of coverage of the at least one sprayer nozzle, whereby the reduction can be complete or partial, for example by eighty percent.

If the transport system is realized so that the container carriers or baskets each form a plurality of container receptacles or cells, each of which holds one container, in the direction at a right angle to the transport direction, as is generally the case on container handling machines, then at least one spray nozzle is associated with each container receptacle or cell of the container carrier.

The above-discussed embodiments of the present invention will be described further herein below. When the word "invention" or "embodiment of the invention" is used in this specification, the word "invention" or "embodiment of the invention" includes "inventions" or "embodiments of the invention", that is the plural of "invention" or "embodiment of the invention". By stating "invention" or "embodiment of the invention", the Applicant does not in any way admit that the present application does not include more than one patentably and non-obviously distinct invention, and maintains that this application may include more than one patentably and non-obviously distinct invention. The Applicant hereby asserts that the disclosure of this application may include more than one invention, and, in the event that there is more than one invention, that these inventions may be patentable and non-obvious one with respect to the other.

BRIEF DESCRIPTION OF THE DRAWINGS

Developments of the present application are described according to the present application. The present application is explained in greater detail below with reference to the possible embodiment which is illustrated in the accompanying drawings, in which.

DESCRIPTION OF EMBODIMENT OR EMBODIMENTS

Figure 1:
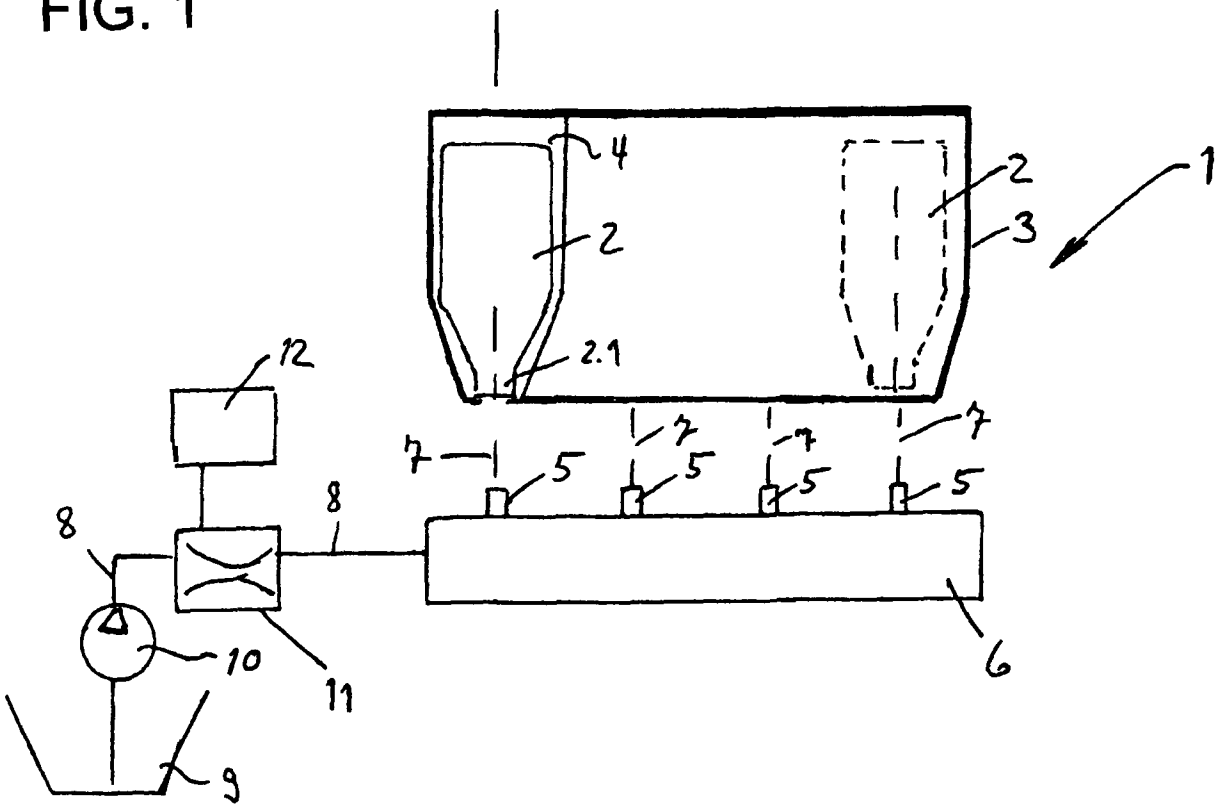
FIG. 1 shows in a highly simplified schematic illustration a sprayer station of a cleaning machine for bottles, together with a bottle basket of a transport system of the cleaning machine, which basket forms a plurality of receptacles or bottle cells.
Figure 2:
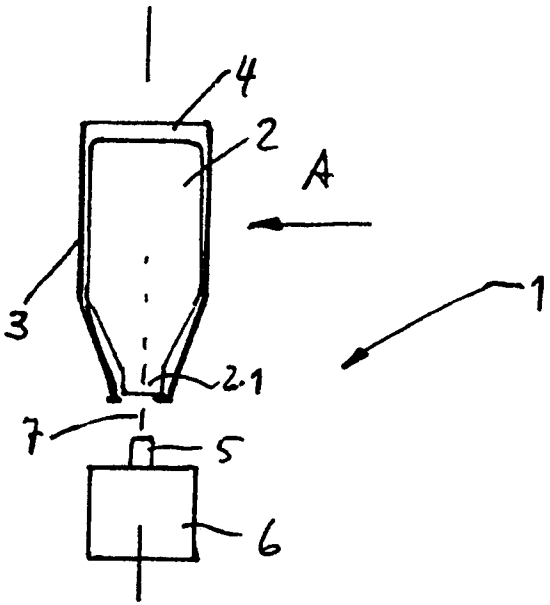
FIG. 2 is a schematic illustration of a side view of the sprayer station illustrated in FIG. 1.

In the figures, 1 is a sprayer station of a cleaning machine for the cleaning of bottles 2 which are moved with a transport system which has a plurality of bottle baskets 3 through various treatment zones of the cleaning machine (not shown), of the type that will be familiar to a technician skilled in the art. FIG. 1 shows the direction of movement or transport of the transport system and of the bottle baskets 3 which is oriented perpendicular or virtually perpendicular to the plane of the drawing of this figure. In FIG. 2, the direction of movement or transport of the bottle baskets 3 is indicated by the arrow A. Each bottle basket forms a plurality of receptacles or bottle cells 4, each of which holds one bottle 2 and are located close to one another in the respective bottle basket 3 perpendicular or virtually perpendicular to the direction of transport of the transport system.

The spraying station 1 is used to spray the interior of the bottles 2 which for this purpose are oriented in the bottle cells 4 with their bottle axes in the vertical direction and with their bottle mouths 2.1 pointed downward in the sprayer station 1 and are moved past a distributor or spray pipe 6 having a plurality of spray nozzles 5. The spray pipe 6 with the spray nozzles 5 is thereby located below the path of movement of the bottle baskets 3 that pass the sprayer station 1, and in one possible embodiment so that the number of spray nozzles 5 is at least equal to the number of bottle cells 4 of each bottle basket 3 and each spray nozzle 5 is located in the vertical direction below the path of movement of each bottle cell 4 or bottle basket 3. Each spray jet 7, which is therefore discharged upward in the vertical direction from a sprayer nozzle 5, can therefore enter the bottles 2 as the bottles or containers 2 move past the sprayer station 1 through the bottle mouths 2.1, which are not covered by the bottle cells 4.

The spray pipe 6 is in communication by means of a supply line 8 with a source 9 for the treatment fluid, such as a liquid cleaning medium such as a caustic solution, for example, or for water, e.g. for fresh water. Located in the line 8 are a pump 10, which makes available the treatment fluid in the required and/or desired quantity and at the required and/or desired pressure, and, at the output of the pump, a flow control valve 11 with which, by means of a control device 12, the spray jets 7 which are discharged from the spray nozzles 5 can be controlled in synchronization or substantial synchronization with the movement of the bottle baskets 3, and in one possible embodiment, for example, so that the feed of the treatment fluid to the spray pipe 6 is reduced or interrupted, as long as no bottles 2 are above the spray nozzles 5 or in the area of coverage of the spray nozzles 5. The result is, among other things, a significant saving in the quantity of liquid spray medium required and/or desired.

Figure 3C:
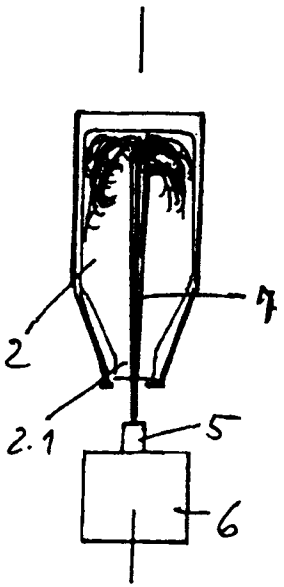
FIGS. 3A, 3B, and 3C show different states of the spray jet of the sprayer station illustrated in FIGS. 1 and 2.
Figure 3B:
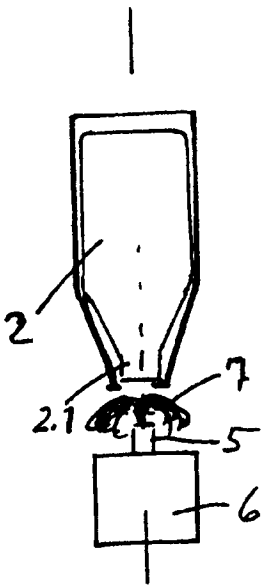
Figure 3A:
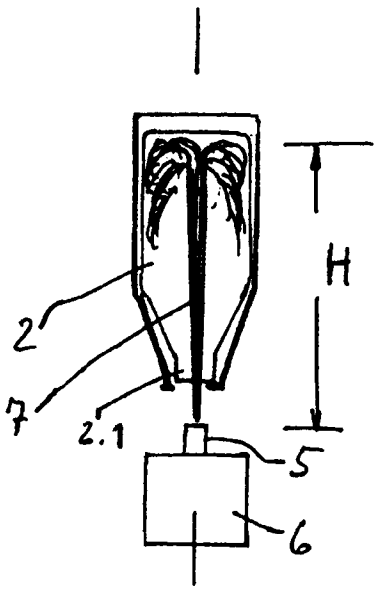

The spray jets 7 can also be controlled in an open-loop or closed-loop control by the flow control valve 11, so that during the respective spray phase, i.e. during the period in which the bottles 2 of the respective bottle basket 3 are located in the area of coverage of the sprayer station 1 and of the spray nozzles 5, the flow of the spray medium at the spray nozzles 5 and/or the pressure of the spray fluid is varied at least once, and in one possible embodiment, for example, so that during the spray phase the spray height H of the spray jets 7 is varied at least once. This variation takes place in the manner illustrated in FIGS. 3A, 3B, and 3C. At the beginning of the respective spraying phase, the treatment fluid is fed to the spray pipe 6 in a quantity and/or at a pressure such that the spray jets 7 extend through the respective bottle mouth 2.1 into the interior of the respective bottle 2 to the bottom of the bottle, which may be seen in FIG. 3A. In another sub-phase, the quantity of treatment fluid and/or the pressure are reduced so that the spray jets 7 end below the respective bottle mouth 2.1 and thus outside the bottle 2, and the bottles 2 can thus run empty. This sub-phase is seen in FIG. 3B. In an additional sub-phase, illustrated in FIG. 3C, the flow quantity and/or the pressure of the treatment fluid is again increased until the spray jets 7 inside the respective bottle 2 again extent to the bottoms of the bottles 2.

In this embodiment, the spray jets 7 are controlled in the manner described above by the flow control valve 11 which can be actuated electrically or pneumatically, for example. Basically it is also possible to achieve this control by means of an open-loop or closed-loop control of the drive of the pump 10, e.g. with a frequency-controlled drive, whereby in this embodiment the flow control valve 11 in the line 8 can be omitted.

In the cleaning machine, there are in one possible embodiment a plurality of sprayer stations 1 of the type described above one after another in the direction of transport A, whereby these sprayer stations 1 can then also be realized for the discharge of different sprayer or cleaning fluids.

By means of a corresponding control system of the movement of the transport system that has the bottle baskets 3 and/or by means of a controlled movement of the sprayer pipe 6 that has the spray nozzles 5, the present application essentially ensures or promotes that each bottle 2 is in the area of coverage of a spray nozzle 5 for a sufficiently long interval of time, i.e. there is a sufficient length of time available for the spray phases. This can be accomplished, for example, if the bottle baskets 3 are in the area of coverage of the sprayer station 1, by reducing the transport speed of the transport system that has these bottle baskets 3 and/or by moving the sprayer pipe 6 is along with the bottle baskets 3 in a controlled manner.

In at least one possible embodiment according to the present application, the control means or control device 12 is configured to reduce the flow of the spraying fluid or treatment fluid or water flowing through the supply line 8 and therefore flowing through the spray pipe 6 and being sprayed from the nozzle 5. In one embodiment, the control means 12 may not shut off the flow of the liquid, but rather permits a reduced flow of the treatment liquid or water. When the flow of liquid is reduced, the height of the spray jet 7 is lessened, i.e. the jet 7 ends outside of the bottle mouth 2.1 of the inverted bottle 2.

The control device 12 is further configured to intensify the flow of the liquid in the supply line 8 and therefore the flow of liquid through the spray pipe 6. An intensified flow in the supply line 8 and spray pipe 6 produces a spray jet 7 with a height that enters the bottle 2 through the bottle mouth 2.1 and extends into the body of the bottle 2. When the flow of liquid in the supply line 8 and pipe 6 is at a higher rate, the pressure inside the supply line 8 and pipe 6 may be greater than when the flow of liquid is reduced.

In at least one possible embodiment of the present application, when the control device 12 reduces the flow of the liquid and reduces the height of the spray jet 7, the control means 12 permits a lesser flow of liquid through the supply line 8 and the pipe 6. By permitting a lesser flow of liquid in the supply line 8 and pipe 6, the equipment may not receive as high of a pressure shock when the control device 12 increases the flow and increases the height of the spray jet 7. Restricting and/or minimizing the intensity of the pressure shocks may minimize or reduce fatiguing of the sprayer equipment.

In at least one possible embodiment of the present application, the flow of liquid in the supply line 8, spray pipe 5, and spray nozzles 5 are reduced to a non-zero flow. When the flow is increased to a higher flow to increase the height of the spray jet 7, less time is desired to reach the higher flow. This process promotes a more time efficient method for cleaning the bottles or containers 2.

Figure 4:
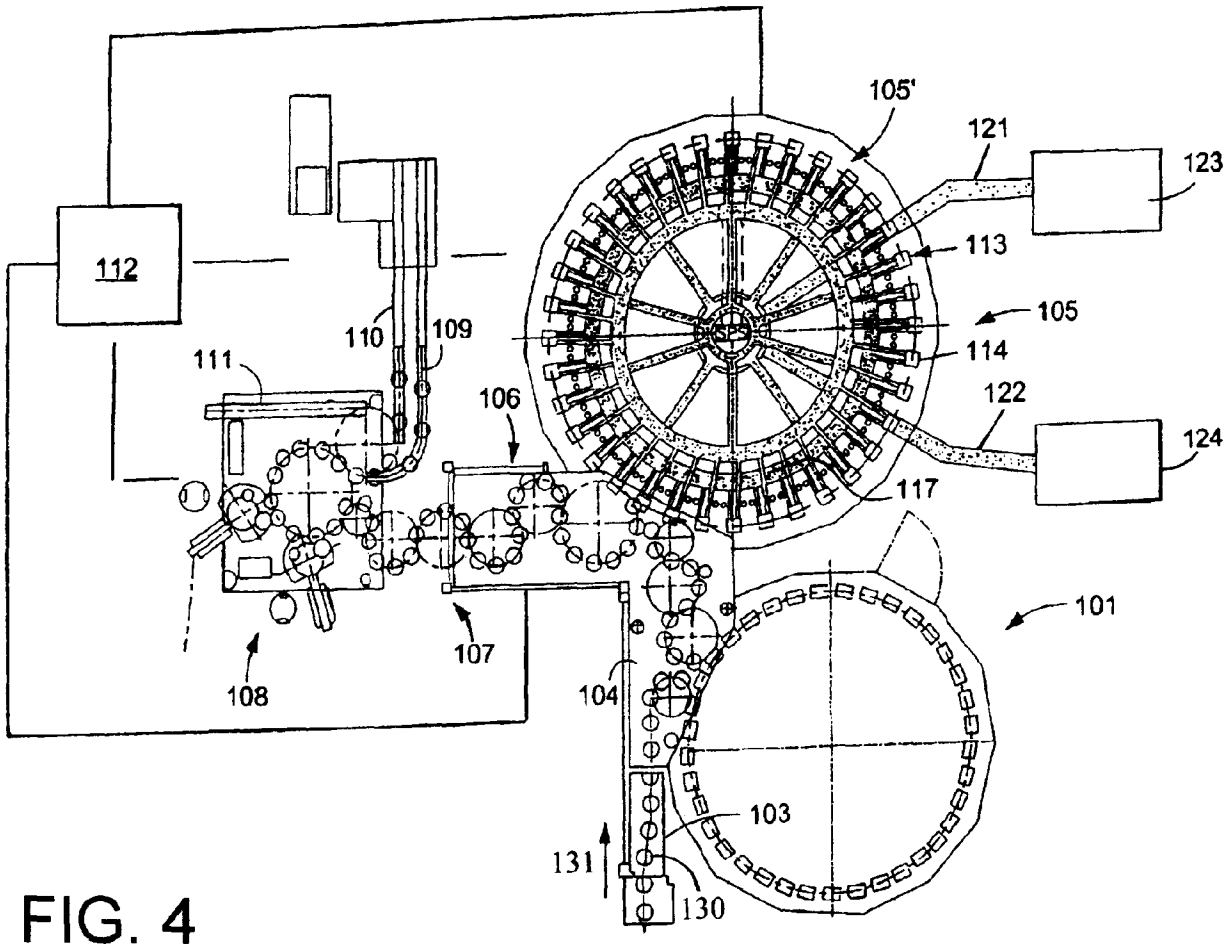
FIG. 4 shows schematically the main components of one possible embodiment example of a system for filling containers, for example a beverage bottling plant for filling bottles with at least one liquid beverage, in accordance with at least one possible embodiment, in which system or plant could possibly be utilized at least one aspect, or several aspects, of the embodiments disclosed herein.

FIG. 4 shows schematically the main components of one possible embodiment example of a system for filling containers, specifically, a beverage bottling plant for filling bottles 130 with at least one liquid beverage, in accordance with at least one possible embodiment, in which system or plant could possibly be utilized at least one aspect, or several aspects, of the embodiments disclosed herein.

FIG. 4 shows a rinsing arrangement or rinsing station 101, to which the containers, namely bottles 130, are fed in the direction of travel as indicated by the arrow 131, by a first conveyer arrangement 103, which can be a linear conveyor or a combination of a linear conveyor and a starwheel. Downstream of the rinsing arrangement or rinsing station 101, in the direction of travel as indicated by the arrow 131, the rinsed bottles 130 are transported to a beverage filling machine 105 by a second conveyer arrangement 104 that is formed, for example, by one or more starwheels that introduce bottles 130 into the beverage filling machine 105.

The beverage filling machine 105 shown is of a revolving or rotary design, with a rotor 105', which revolves around a central, vertical machine axis. The rotor 105' is designed to receive and hold the bottles 130 for filling at a plurality of filling positions 113 located about the periphery of the rotor 105'. At each of the filling positions 103 is located a filling arrangement 114 having at least one filling device, element, apparatus, or valve. The filling arrangements 114 are designed to introduce a predetermined volume or amount of liquid beverage into the interior of the bottles 130 to a predetermined or desired level.

The filling arrangements 114 receive the liquid beverage material from a toroidal or annular vessel 117, in which a supply of liquid beverage material is stored under pressure by a gas. The toroidal vessel 117 is a component, for example, of the revolving rotor 105'. The toroidal vessel 117 can be connected by means of a rotary coupling or a coupling that permits rotation. The toroidal vessel 117 is also connected to at least one external reservoir or supply of liquid beverage material by a conduit or supply line. In the embodiment shown in FIG. 4, there are two external supply reservoirs 123 and 124, each of which is configured to store either the same liquid beverage product or different products. These reservoirs 123, 124 are connected to the toroidal or annular vessel 117 by corresponding supply lines, conduits, or arrangements 121 and 122. The external supply reservoirs 123, 124 could be in the form of simple storage tanks, or in the form of liquid beverage product mixers, in at least one possible embodiment.

As well as the more typical filling machines having one toroidal vessel, it is possible that in at least one possible embodiment there could be a second toroidal or annular vessel which contains a second product. In this case, each filling arrangement 114 could be connected by separate connections to each of the two toroidal vessels and have two individually-controllable fluid or control valves, so that in each bottle 130, the first product or the second product can be filled by means of an appropriate control of the filling product or fluid valves.

Downstream of the beverage filling machine 105, in the direction of travel of the bottles 130, there can be a beverage bottle closing arrangement or closing station 106 which closes or caps the bottles 130. The beverage bottle closing arrangement or closing station 106 can be connected by a third conveyer arrangement 107 to a beverage bottle labeling arrangement or labeling station 108. The third conveyor arrangement may be formed, for example, by a plurality of starwheels, or may also include a linear conveyor device.

In the illustrated embodiment, the beverage bottle labeling arrangement or labeling station 108 has at least one labeling unit, device, or module, for applying labels to bottles 130. In the embodiment shown, the labeling arrangement 108 is connected by a starwheel conveyer structure to three output conveyer arrangements: a first output conveyer arrangement 109, a second output conveyer arrangement 110, and a third output conveyer arrangement 111, all of which convey filled, closed, and labeled bottles 130 to different locations.

The first output conveyer arrangement 109, in the embodiment shown, is designed to convey bottles 130 that are filled with a first type of liquid beverage supplied by, for example, the supply reservoir 123. The second output conveyer arrangement 110, in the embodiment shown, is designed to convey bottles 130 that are filled with a second type of liquid beverage supplied by, for example, the supply reservoir 124. The third output conveyer arrangement 111, in the embodiment shown, is designed to convey incorrectly labeled bottles 130. To further explain, the labeling arrangement 108 can comprise at least one beverage bottle inspection or monitoring device that inspects or monitors the location of labels on the bottles 130 to determine if the labels have been correctly placed or aligned on the bottles 130. The third output conveyer arrangement 111 removes any bottles 130 which have been incorrectly labeled as determined by the inspecting device.

The beverage bottling plant can be controlled by a central control arrangement 112, which could be, for example, computerized control system that monitors and controls the operation of the various stations and mechanisms of the beverage bottling plant.

The present application was described above on the basis of one possible embodiment. It goes without saying that numerous modifications and variations can be made without thereby going beyond the teaching of the present application.

In the above explanation, it was assumed that the spray nozzles each produce a spray jet 7 oriented upward in the vertical direction. Of course, it is also possible, instead of the spray nozzles 7, to provide arrangements of spray nozzles, each of which produces a plurality of spray jets and/or spray nozzles or arrangements of spray nozzles which produce at least one spray jet which moves, e.g. rotates, during the spraying phase for an improved treatment of the interior surfaces of the bottles 2.

Figure 5:
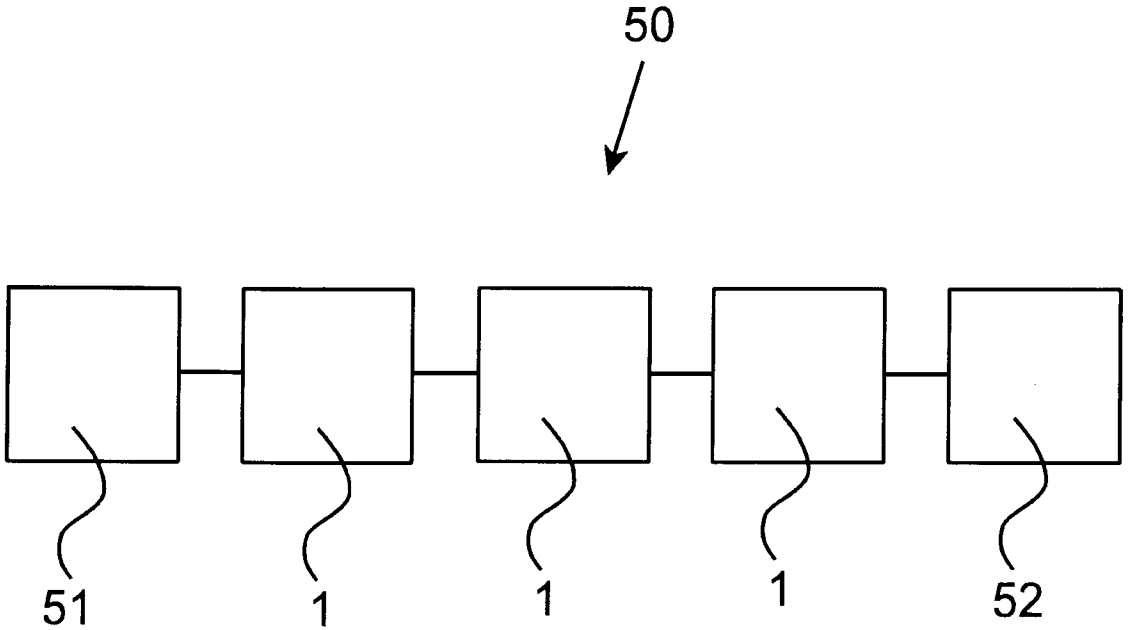
FIG. 5 shows a simplified representation of a cleaning or rinsing or treating machine comprises a plurality of sprayer stations according to the present application.

FIG. 5 shows a block diagram of a cleaning machine or rinsing machine or treating machine 50 according to the present application. The cleaning machine 50 comprises an input 51, at which point bottles or containers 2 may be fed into or moved into the cleaning machine 50. The bottles 2 are then transported to a first sprayer station 1, where the bottles 2 are treated with a first medium or fluid, such as water. Once the first spraying phase is completed, the bottles 2 may be then transported to a second sprayer station 1, where the bottles 2 are treated with a second medium or fluid, such as a cleaning fluid. When the second spraying phase is completed, the bottles 2 may be then transported to a third sprayer station 1, where the bottles 2 are treated with a third medium or fluid, such as a disinfecting fluid. The cleaning machine or rinsing machine or treating machine 50 also comprises an output 52. After the spraying phases are completed, the bottles or containers 2 may be fed out of or moved out of the treating machine at the output 52.

Additionally, in at least one possible embodiment of the present application, the treated bottles or containers 2 may be transported from or moved from the output 52 to an inspection station or inspection system. At this inspection station, the treated or cleaned bottles 2 may be inspected for contaminants and/or for cleanliness. If a bottle or container 2 is determined to be not sufficiently clean, or is determined to still have contaminants, that bottle or container 2 may be transported back to the input 51 of the treating machine 50.

In at least one possible embodiment of the present application, the number of sprayer stations 1 in a cleaning machine 50 may vary. For example, as described above, the cleaning machine 50 may comprise three sprayer stations 1. However, the rinsing machine 50 of the present application may not be limited to three sprayer stations 1. The treating machine may comprise one or two sprayer stations 1, and may also comprise more than three sprayer stations 1.

In the above description, it was also indicated that the at least one spray jet gets into the interior of the containers. It is also within the teaching of this present application, however, if the spray jet or spray jets are varied so that, for example, they can spray areas of the outside of the containers and/or interior or exterior areas of bottle cells 4 and/or bottle baskets 3.

It is also within the scope of this present application to vary the spray jet as a function of the chronological sequence of the work cycle.

For example, the reduction of the spray jet can begin, for example, at a first instant of the work cycle and end at a second instant of the work cycle.

Sprayer station of a cleaning machine for the cleaning of bottles or similar containers with at least one spray nozzle for the introduction of a spray or treatment fluid into the containers with a container mouth that are being moved past the spray nozzle by means of a transport system during a spraying phase, in which the individual containers are located in the area of coverage of the at least one spray nozzle, and with means to vary the at least one spray jet during the respective spraying phase.

One feature or aspect of an embodiment is believed at the time of the filing of this patent application to possibly reside broadly in a sprayer station of a cleaning machine for the cleaning of bottles or similar containers 2 with at least one spray nozzle 5 for the introduction of at least one spray jet 7 of a spray or treatment fluid into the containers 2 with a container mouth 2.1 that are being moved past the spray nozzle 5 by means of a transport system 3, 4 during a spraying phase, in which the individual containers 2 are located in the area of coverage of the at least one spray nozzle 5, and with means 10, 11, 12 to vary the at least one spray jet 7, wherein the means 10, 11, 12 for the variation of the spray jet 7 are realized so that the at least one spray jet 7 is varied at least once during each work cycle or during each spraying phase.

Another feature or aspect of an embodiment is believed at the time of the filing of this patent application to possibly reside broadly in the sprayer station, wherein the at least one spray jet 7 is interrupted at least once during each spraying phase.

Yet another feature or aspect of an embodiment is believed at the time of the filing of this patent application to possibly reside broadly in the sprayer station, wherein the height H of the at least one spray jet 7 is varied at least once during each work cycle or during each spraying phase, without a complete interruption of the spray jet 7.

Still another feature or aspect of an embodiment is believed at the time of the filing of this patent application to possibly reside broadly in the sprayer station, wherein during each work cycle or during each spraying phase, the height of the spray jet 7 is varied so that the at least one spray jet 7 extends at least during a period of time or a sub-phase during the spraying phase into the respective container 2, and ends short of the container mouth 2.1 outside the container 2 in at least one additional sub-phase of the spraying phase.

A further feature or aspect of an embodiment is believed at the time of the filing of this patent application to possibly reside broadly in the sprayer station, wherein the at least one spray jet 7, at least during a sub-phase of the spraying phase, strikes an area which is vertically above the container mouth 2.1, e.g. the bottom of the container.

Another feature or aspect of an embodiment is believed at the time of the filing of this patent application to possibly reside broadly in the sprayer station, wherein the at least one spray jet 7 is controlled so that during the work cycle or during the spraying phase, it extends in at least two sub-phases into the respective container 2, in one possible embodiment to the bottom of the container 2 which is opposite the container mouth 2.1, and in an intermediate phase between these sub-phases ends outside the respective container 2 short of the bottle mouth 2.1.

Yet another feature or aspect of an embodiment is believed at the time of the filing of this patent application to possibly reside broadly in the sprayer station, wherein the at least one spray nozzle 5 is located below the path of movement of the containers 2 or of the container mouths 2.1.

Still another feature or aspect of an embodiment is believed at the time of the filing of this patent application to possibly reside broadly in the sprayer station, wherein the at least one spray jet 7 is directed vertically upward starting from the spray nozzle 5 or essentially vertically upward.

A further feature or aspect of an embodiment is believed at the time of the filing of this patent application to possibly reside broadly in the sprayer station, wherein the means for the control of the at least one spray jet 7 are formed by a controllable valve 11 which is located in a supply line 8 of the at least one spray nozzle, for example a flow control valve, and/or by a controlled drive of a pump 10 for the treatment fluid.

Another feature or aspect of an embodiment is believed at the time of the filing of this patent application to possibly reside broadly in the sprayer station, wherein in a transport system with container carriers 3, each of which forms a plurality of receptacles 4 for the containers 2 next to one another at a right angle or perpendicular or substantially perpendicular to the direction of transport A, at least one spray nozzle 5 is associated with each container receptacle 4.

Yet another feature or aspect of an embodiment is believed at the time of the filing of this patent application to possibly reside broadly in the sprayer station, wherein the spray nozzles 5 are provided on a common nozzle carrier.

Still another feature or aspect of an embodiment is believed at the time of the filing of this patent application to possibly reside broadly in the sprayer station, wherein the nozzle carrier is a spray pipe 6 for the distribution of the treatment fluid to the spray nozzles 5.

A further feature or aspect of an embodiment is believed at the time of the filing of this patent application to possibly reside broadly in the sprayer station, wherein the spray nozzles 5 have a fixed vertical or virtually vertical orientation.

One feature or aspect of an embodiment is believed at the time of the filing of this patent application to possibly reside broadly in the sprayer station, wherein the at least one spray nozzle 5 can be pivoted by at least one drive mechanism at least during the spraying phase.

Another feature or aspect of an embodiment is believed at the time of the filing of this patent application to possibly reside broadly in a container cleaning machine for the cleaning of bottles or similar containers, with at least one sprayer station past which the containers 2 are moved in container receptacles 4, wherein the sprayer station is realized as the sprayer station according to the present application.

Yet another feature or aspect of an embodiment is believed at the time of the filing of this patent application to possibly reside broadly in the container cleaning machine, wherein there are at least two sprayer stations 1 one after the other in a direction of transport A of the transport system.

Still another feature or aspect of an embodiment is believed at the time of the filing of this patent application to possibly reside broadly in a method for the operation of a container cleaning machine for the cleaning of bottles or similar containers with at least one sprayer station past which the containers 2 are moved in container receptacles 4, wherein the at least one spray jet is varied at least once during a work cycle or during a spraying phase.

A further feature or aspect of an embodiment is believed at the time of the filing of this patent application to possibly reside broadly in the method, wherein the height of the at least one spray jet is varied.

Another feature or aspect of an embodiment is believed at the time of the filing of this patent application to possibly reside broadly in the method, wherein the height of the spray jet is reduced from a first height to a second height which is lower than the first height and is simultaneously or substantially simultaneously greater than zero.

Yet another feature or aspect of an embodiment is believed at the time of the filing of this patent application to possibly reside broadly in the method, wherein the at least one spray jet is reduced to the height zero.

Still another feature or aspect of an embodiment is believed at the time of the filing of this patent application to possibly reside broadly in the method, wherein the spray jet is varied in a controlled manner.

A further feature or aspect of an embodiment is believed at the time of the filing of this patent application to possibly reside broadly in the method, wherein the spray jet is varied as a function of the chronological sequence of the work cycle.

One feature or aspect of an embodiment is believed at the time of the filing of this patent application to possibly reside broadly in a method of cleaning returned beverage bottles in a bottle filling plant, said method comprising the steps of: feeding bottles into a bottle cleaning machine; transporting said bottles into a cleaning station of said bottle cleaning machine; pumping, with a pump, a first substantially steady non-pulsing flow of a treatment fluid through a supply line and out of a plurality of nozzles, and thereby ejecting treatment fluid, from a plurality of nozzles, to a first height, which first height is sufficiently high to contact and dislodge any contaminants on the inside surfaces of said bottles; dislodging any contaminants on the inside surfaces of said bottles; upon completion of a first period of time, controlling said pump and a valve with a control device and reducing the flow of said treatment fluid to a second substantially steady non-pulsing non-zero flow of said treatment fluid less than said first substantially steady non-pulsing flow, and thereby ejecting treatment fluid, from said plurality of nozzles, to a second non-zero height less than said first height, which second non-zero height is sufficiently low to minimize entry of treatment fluid into said bottles and to permit treatment fluid and contaminants to flow out of said bottles; permitting ejected treatment fluid and any contaminants to flow out of said bottles; upon completion of a second period of time, controlling said pump and said valve with said control device and increasing the flow of said treatment fluid to said first substantially steady non-pulsing flow of said treatment fluid, and thereby ejecting treatment fluid, from said plurality of nozzles, to said first height; dislodging any remaining contaminants on the inside surfaces of said bottles; permitting ejected treatment fluid and any remaining contaminants to flow out of said bottles; upon completion of a third period of time, moving cleaned bottles out of said bottle cleaning machine; moving said cleaned bottles into a bottle filling machine; filling said cleaned bottles with a beverage; and capping said filled, cleaned bottles.

Another feature or aspect of an embodiment is believed at the time of the filing of this patent application to possibly reside broadly in a method of introducing treatment fluid into containers to remove contaminants therefrom in a container filling plant, said method comprising the steps of: moving at least one container into a container treating machine; ejecting, from at least one orifice, a substantially steady flow of treatment fluid to a first height being sufficiently high and having a sufficient volume to remove contaminants from the interior of said at least one container; removing contaminants from the interior of said at least one container; reducing the substantially steady flow of treatment fluid and thereby ejecting, from said at least one orifice, a substantially steady flow of treatment fluid to a second non-zero height substantially less than said first height, which second non-zero height is sufficiently low to minimize entry of treatment fluid into said at least one container and to permit treatment fluid and contaminants to flow out of said at least one container; permitting treatment fluid and contaminants to flow out of said at least one container; moving said at least one treated container out of said container treating machine; filling said at least one treated container; and closing said at least one filled, treated container.

Yet another feature or aspect of an embodiment is believed at the time of the filing of this patent application to possibly reside broadly in a treating arrangement for performing the method of introducing treatment fluid into containers to remove contaminants therefrom in a container filling plant, said treating arrangement comprising: a first moving arrangement being configured to move at least one container into a container treating machine; an ejecting arrangement being configured to eject, from at least one orifice, a substantially steady flow of treatment fluid to a first height being sufficiently high and having a sufficient volume to remove contaminants from the interior of at least one container; a removing arrangement being configure to remove contaminants from the interior of at least one container; a reducing arrangement being configured to reduce the substantially steady flow of treatment fluid and thereby eject, from said at least one orifice, a substantially steady flow of treatment fluid to a second non-zero height substantially less than the first height, which second non-zero height is sufficiently low to minimize entry of treatment fluid into at least one container and to permit treatment fluid and contaminants to flow out of at least one container; a permitting arrangement being configured to permit treatment fluid and contaminants to flow out of at least one container; a second moving arrangement being configured to move at least one treated container out of said container treating machine; a filling arrangement being configured to fill at least one treated container; and a closing arrangement being configured to close at least one filled, treated container.

The components disclosed in the various publications, disclosed or incorporated by reference herein, may possibly be used in possible embodiments of the present invention, as well as equivalents thereof.

The purpose of the statements about the technical field is generally to enable the Patent and Trademark Office and the public to determine quickly, from a cursory inspection, the nature of this patent application. The description of the technical field is believed, at the time of the filing of this patent application, to adequately describe the technical field of this patent application. However, the description of the technical field may not be completely applicable to the claims as originally filed in this patent application, as amended during prosecution of this patent application, and as ultimately allowed in any patent issuing from this patent application. Therefore, any statements made relating to the technical field are not intended to limit the claims in any manner and should not be interpreted as limiting the claims in any manner.

The appended drawings in their entirety, including all dimensions, proportions and/or shapes in at least one embodiment of the invention, are accurate and are hereby included by reference into this specification.

The background information is believed, at the time of the filing of this patent application, to adequately provide background information for this patent application. However, the background information may not be completely applicable to the claims as originally filed in this patent application, as amended during prosecution of this patent application, and as ultimately allowed in any patent issuing from this patent application. Therefore, any statements made relating to the background information are not intended to limit the claims in any manner and should not be interpreted as limiting the claims in any manner.

All, or substantially all, of the components and methods of the various embodiments may be used with at least one embodiment or all of the embodiments, if more than one embodiment is described herein.

The purpose of the statements about the object or objects is generally to enable the Patent and Trademark Office and the public to determine quickly, from a cursory inspection, the nature of this patent application. The description of the object or objects is believed, at the time of the filing of this patent application, to adequately describe the object or objects of this patent application. However, the description of the object or objects may not be completely applicable to the claims as originally filed in this patent application, as amended during prosecution of this patent application, and as ultimately allowed in any patent issuing from this patent application. Therefore, any statements made relating to the object or objects are not intended to limit the claims in any manner and should not be interpreted as limiting the claims in any manner.

All of the patents, patent applications and publications recited herein, and in the Declaration attached hereto, are hereby incorporated by reference as if set forth in their entirety herein.

The summary is believed, at the time of the filing of this patent application, to adequately summarize this patent application. However, portions or all of the information contained in the summary may not be completely applicable to the claims as originally filed in this patent application, as amended during prosecution of this patent application, and as ultimately allowed in any patent issuing from this patent application. Therefore, any statements made relating to the summary are not intended to limit the claims in any manner and should not be interpreted as limiting the claims in any manner.

It will be understood that the examples of patents, published patent applications, and other documents which are included in this application and which are referred to in paragraphs which state "Some examples of . . . which may possibly be used in at least one possible embodiment of the present application . . . " may possibly not be used or useable in any one or more embodiments of the application.

The sentence immediately above relates to patents, published patent applications and other documents either incorporated by reference or not incorporated by reference.

U.S. patent application Ser. No. 12/389,937, filed on Feb. 20, 2009, and title "METHOD OF CLEANING BOTTLES IN A BOTTLE CLEANING MACHINE, AND AN ARRANGEMENT FOR PERFORMING THE METHOD, AND A BOTTLE CLEANING MACHINE," is hereby incorporated by reference as if set forth in its entirety herein.

Some examples of inspection systems for inspecting containers for contaminants and methods for performing such inspections, which may possibly be utilized or adapted for use in at least one possible embodiment according to the present application may possibly be found in the following patents: No. 5,733,783, having the title "METHOD FOR SAMPLING AND DETERMINING THE PRESENCE OF CONTAMINANTS IN RECYCLABLE PLASTIC MATERIALS," published on Mar. 31, 1998; No. 5,688,693, having the title "METHOD AND SYSTEM FOR SAMPLING AND DETERMINING THE PRESENCE OF CONTAMINANTS IN RECYCLABLE PLASTIC MATERIALS," published on Nov. 18, 1997; and No. 5,569,606, having the title "METHOD AND SYSTEM FOR SAMPLING AND DETERMINING THE PRESENCE OF CONTAMINANTS IN RECYCLABLE PLASTIC MATERIALS," published on Oct. 29, 1996.

Some examples of filling machine cleaning methods and apparatus that may possibly be utilized or possibly adapted for use in at least one possible embodiment of the present application may possibly be found in the following patent publications: U.S. Pat. No. 3,964,526 issued to Sindermann on Jun. 22, 1976; U.S. Pat. No. 5,173,259 issued to Bordini on Dec. 22, 1992; U.S. Pat. No. 5,558,138 issued to Stock et al. on Sep. 24, 1996; German Patent No. DE-PS 30 17 197 issued on Jan. 2, 1987; German Laid Open Patent Application No. 39 27 401 published on Feb. 21, 1991; German Laid Open Patent Application No. 41 09 731 published on Oct. 31, 1991; and European Patent No. 0 644 152 published on Mar. 22, 1995.

Some examples of apparatus and methods of sterilizing or cleaning containers that may possibly be utilized or possibly adapted for use in at least one possible embodiment of the present application may possibly be found in the following U.S. patents: No. 5,092,356 issued to Grot on Mar. 3, 1992; No. 5,320,144 issued to Ahlers on Jun. 14, 1994; No. 5,533,552 issued to Ahlers on Jul. 9, 1996; No. 5,558,135 issued to Kronseder et al. on Sep. 24, 1996; and No. 5,896,899 issued to Schlitz on Apr. 27, 1999.

Some examples of sterilizing or cleaning agents and concentrations thereof that may possibly be utilized or possibly adapted for use in at least one possible embodiment of the present application may possibly be found in the following U.S. patents: No. 6,039,922 issued to Swank et al. on Mar. 21, 2000; No. 6,244,275 issued to Ziegler et al. on Jun. 12, 2001; No. 6,406,666 issued to Cicla et al. on Jun. 18, 2002; and No. 6,612,149 issued to Wang et al. on Sep. 2, 2003.

All of the patents, patent applications or patent publications, which were cited in the International Search Report dated Feb. 18, 2008, and/or cited elsewhere are hereby incorporated by reference as if set forth in their entirety herein as follows: U.S. Pat. No. 3,952,925, having the title "FLOW CONTROL SYSTEM AND ROTARY FLOW CONTROL VALVE," published on Apr. 27, 1976; EP 0 134 830, having the following English translation of the German title "SPRAY NOZZLE FOR BOTTLE CLEANING MACHINES," published on Mar. 27, 1985; DE 43 35 368, having the following English translation of the German title "DEVICE FOR CLEANING BOTTLES," published on Apr. 20, 1995; DE 196 37 860, having the following German title "VORRICHTUNG ZUM TRANSPORTIEREN VON FLASCHEN IN EINER FLASCHENREINIGUNGSMASCHINE," published on Mar. 19, 1998; DE 44 12 441, having the following English translation of the German title "WASHING MACHINE FOR PLASTIC BOTTLES WITH NECK COLLAR," published on Nov. 2, 1995; and US 2006/213541, having the title "Apparatus and method for cleaning bottles," published on Sep. 28, 2006.

All of the patents, patent applications or patent publications, which were cited in the German Office Action dated Oct. 30, 2007, and/or cited elsewhere are hereby incorporated by reference as if set forth in their entirety herein as follows: DE 43 30 335, having the following English translation of the German title, "SPRAYING DEVICE FOR BOTTLE CLEANING MACHINES," published on Mar. 9, 1995; and DE 7 102 512, having the following German title "SCHWENKBARER SPRITZROHRWAGEN MIT SCHWENKDUESE ZUR REINIGUNG VON GEFAESSEN," published on Apr. 15, 1971.

The patents, patent applications, and patent publication listed above in the preceding seven paragraphs are herein incorporated by reference as if set forth in their entirety. The purpose of incorporating U.S. patents, non-U.S. patents, publications, etc. is solely to provide additional information relating to technical features of one or more embodiments, which information may not be completely disclosed in the wording in the pages of this application. Words relating to the opinions and judgments of the author and not directly relating to the technical details of the description of the embodiments therein are not incorporated by reference. The words all, always, absolutely, consistently, preferably, guarantee, particularly, constantly, ensure, necessarily, immediately, endlessly, avoid, exactly, continually, expediently, need, must, only, perpetual, precise, perfect, require, requisite, simultaneous, total, unavoidable, and unnecessary, or words substantially equivalent to the above-mentioned words in this sentence, when not used to describe technical features of one or more embodiments, are not considered to be incorporated by reference herein.

The corresponding foreign and international patent publication applications, namely, Federal Republic of Germany Patent Application No. 10 2006 053 970.4, filed on Nov. 10, 2006, having inventors Bernd MOLITOR, Ulrich WIEDEMANN, and Falk DITTRICH, and DE-OS 10 2006 053 970.4 and DE-PS 10 2006 053 970.4, and International Application No. PCT/EP2007/009630, filed on Nov. 7, 2007, having WIPO Publication No. WO 2008/055663 and Bernd MOLITOR, Ulrich WIEDEMANN, and Falk DITTRICH, are hereby incorporated by reference as if set forth in their entirety herein for the purpose of correcting and explaining any possible misinterpretations of the English translation thereof. In addition, the published equivalents of the above corresponding foreign and international patent publication applications, and other equivalents or corresponding applications, if any, in corresponding cases in the Federal Republic of Germany and elsewhere, and the references and documents cited in any of the documents cited herein, such as the patents, patent applications and publications, are hereby incorporated by reference as if set forth in their entirety herein.

The purpose of incorporating the corresponding foreign equivalent patent application(s), that is, PCT/EP2007/009630 and German Patent Application 10 2006 053 970.4, is solely for the purpose of providing a basis of correction of any wording in the pages of the present application, which may have been mistranslated or misinterpreted by the translator. Words relating to opinions and judgments of the author and not directly relating to the technical details of the description of the embodiments therein are not to be incorporated by reference. The words all, always, absolutely, consistently, preferably, guarantee, particularly, constantly, ensure, necessarily, immediately, endlessly, avoid, exactly, continually, expediently, need, must, only, perpetual, precise, perfect, require, requisite, simultaneous, total, unavoidable, and unnecessary, or words substantially equivalent to the above-mentioned word in this sentence, when not used to describe technical features of one or more embodiments, are not generally considered to be incorporated by reference herein.

Statements made in the original foreign patent applications PCT/EP2007/009630 and DE 10 2006 053 970.4 from which this patent application claims priority which do not have to do with the correction of the translation in this patent application are not to be included in this patent application in the incorporation by reference.

All of the references and documents, cited in any of the documents cited herein, are hereby incorporated by reference as if set forth in their entirety herein. All of the documents cited herein, referred to in the immediately preceding sentence, include all of the patents, patent applications and publications cited anywhere in the present application.

The description of the embodiment or embodiments is believed, at the time of the filing of this patent application, to adequately describe the embodiment or embodiments of this patent application. However, portions of the description of the embodiment or embodiments may not be completely applicable to the claims as originally filed in this patent application, as amended during prosecution of this patent application, and as ultimately allowed in any patent issuing from this patent application. Therefore, any statements made relating to the embodiment or embodiments are not intended to limit the claims in any manner and should not be interpreted as limiting the claims in any manner.

The details in the patents, patent applications and publications may be considered to be incorporable, at applicant's option, into the claims during prosecution as further limitations in the claims to patentably distinguish any amended claims from any applied prior art.

The purpose of the title of this patent application is generally to enable the Patent and Trademark Office and the public to determine quickly, from a cursory inspection, the nature of this patent application. The title is believed, at the time of the filing of this patent application, to adequately reflect the general nature of this patent application. However, the title may not be completely applicable to the technical field, the object or objects, the summary, the description of the embodiment or embodiments, and the claims as originally filed in this patent application, as amended during prosecution of this patent application, and as ultimately allowed in any patent issuing from this patent application. Therefore, the title is not intended to limit the claims in any manner and should not be interpreted as limiting the claims in any manner.

The abstract of the disclosure is submitted herewith as required by 37 C.F.R. §1.72(b). As stated in 37 C.F.R. §1.72 (b):

> A brief abstract of the technical disclosure in the specification must commence on a separate sheet, preferably following the claims, under the heading "Abstract of the Disclosure." The purpose of the abstract is to enable the Patent and Trademark Office and the public generally to determine quickly from a cursory inspection the nature and gist of the technical disclosure. The abstract shall not be used for interpreting the scope of the claims.

Therefore, any statements made relating to the abstract are not intended to limit the claims in any manner and should not be interpreted as limiting the claims in any manner.

The embodiments of the invention described herein above in the context of the preferred embodiments are not to be taken as limiting the embodiments of the invention to all of the provided details thereof, since modifications and variations thereof may be made without departing from the spirit and scope of the embodiments of the invention.

AT LEAST PARTIAL NOMENCLATURE

1 Sprayer station
2 Bottle
2.1 Bottle mouth
3 Bottle basket
4 Bottle cell
5 Spray nozzle
6 Spray pipe
7 Spray jet
8 Line
9 Source for treatment fluid
10 Pump
11 Flow control valve
12 Control device
A Direction of transport
H Height of the spray jet

What is claimed is:

1. A beverage container cleaning arrangement comprising:

a nozzle configured to expel a stream of treatment fluid upwardly toward an inverted beverage container;

a transport arrangement configured to move an inverted beverage container above said nozzle; and a control arrangement with a computerized control system configured to vary flow quantity and/or pressure of a treatment fluid during expelling of a stream of treatment fluid, such that a stream of treatment fluid is first expelled by said nozzle and into an inverted beverage container, then is reduced such that the stream essentially ends outside of the inverted beverage container and above said nozzle, and then is increased, subsequent to being reduced, such that the stream enters the inverted beverage container.

2. The beverage container cleaning arrangement according to claim 1, wherein said control arrangement is configured to maintain a stream outside of an inverted beverage container for a time sufficient to permit treatment fluid to drain out of the inverted beverage container.

3. The beverage container cleaning arrangement according to claim 2, wherein said control arrangement is configured to maintain a stream in contact with the bottom surface of the inverted beverage container, upon a stream being expelled into an inverted beverage container.

4. The beverage container cleaning arrangement according to claim 3, wherein said nozzle comprises a spray nozzle configured to spray a jet of treatment fluid.

5. The beverage container cleaning arrangement according to claim 4, wherein said control arrangement comprises at least one of:

a controllable valve or flow control valve configured to control flow of treatment fluid in a supply line; and a controllable drive configured to control a pump for treatment fluid.

6. The beverage container cleaning arrangement according to claim 5, wherein:

said transport arrangement comprises container carriers, each comprising a plurality of receptacles disposed next to one another at a right angle or perpendicular to the direction of transport;

each of said receptacles is configured to hold a beverage container; and said beverage container cleaning arrangement comprises a plurality of said spray nozzles, wherein each of said spray nozzles is associated with only one of said container receptacles, and each of said container receptacles is associated with only one of said spray nozzles.

7. The beverage container cleaning arrangement according to claim 6, wherein:

each of said spray nozzles is disposed on a common nozzle carrier, which comprises a pipe configured to distribute treatment fluid to said spray nozzles;

said beverage container cleaning arrangement comprises at least two groups of said spray nozzles, disposed one after the other in a direction of transport of said transport arrangement; and said controllable drive comprises a closed-loop drive.

8. The beverage container cleaning arrangement according to claim 7, wherein said beverage container cleaning arrangement comprises at least one drive mechanism configured to pivot said spray nozzles at least during spraying.

9. The beverage container cleaning arrangement according to claim 1, wherein said nozzle comprises a spray nozzle configured to spray a jet of treatment fluid.

10. The beverage container cleaning arrangement according to claim 1, wherein said beverage container cleaning arrangement comprises at least one drive mechanism configured to pivot said nozzle.

11. A method of cleaning beverage containers using a beverage container cleaning arrangement, said method comprising:

moving, using a transport arrangement, an inverted beverage container above a nozzle configured to expel treatment fluid upwardly toward said inverted beverage container;

expelling a stream of treatment fluid from said nozzle into said inverted beverage container through an opening in said inverted beverage container;

then, using a control arrangement, varying the flow quantity and/or pressure of said treatment fluid, and thereby reducing said stream such that said stream essentially ends outside of said inverted beverage container and above said nozzle; and then, subsequent to reducing said stream, varying the flow quantity and/or pressure of said treatment fluid, and thereby increasing said stream such that said stream enters said inverted beverage container.

12. The method according to claim 11, wherein said method further comprises maintaining said stream outside of said inverted beverage container for a time sufficient to permit treatment fluid to drain out of said inverted beverage container.

13. The method according to claim 12, wherein said step of expelling said stream into said inverted beverage container comprises spraying and maintaining said stream in contact with the bottom surface of said inverted beverage container.

14. The method according to claim 13, wherein said nozzle comprises a spray nozzle configured to spray a jet of treatment fluid, and said step of expelling said stream of treatment fluid comprises spraying a jet of treatment fluid from said spray nozzle.

15. The method according to claim 14, wherein said method further comprises stopping said jet upon containers not being present above said spray nozzle.

16. The method according to claim 15, wherein said beverage container cleaning arrangement comprises a drive mechanism configured to pivot said spray nozzle, and said method further comprises pivoting said spray nozzle during spraying.

17. The method according to claim 11, wherein said step of expelling said stream into said inverted beverage container comprises spraying and maintaining said stream in contact with the bottom surface of said inverted beverage container.

18. The method according to claim 11, wherein said nozzle comprises a spray nozzle configured to spray a jet of treatment fluid, and said step of expelling said stream of treatment fluid comprises spraying a jet of treatment fluid from said spray nozzle.

19. The method according to claim 11, wherein said method further comprises stopping said stream upon containers not being present above said nozzle.

20. The method according to claim 11, wherein said beverage container cleaning arrangement comprises a drive mechanism configured to pivot said nozzle, and said method further comprises pivoting said nozzle during expelling of said stream.

* * * * *